US008317581B2

(12) United States Patent
Prucey

(10) Patent No.: US 8,317,581 B2
(45) Date of Patent: Nov. 27, 2012

(54) PUZZLE GAME

(75) Inventor: James Prucey, New York, NY (US)

(73) Assignee: Canned Bananas LLC, New York, NY (US)

( * ) Notice: Subject to any disclaimer, the term of this patent is extended or adjusted under 35 U.S.C. 154(b) by 568 days.

(21) Appl. No.: 12/434,281

(22) Filed: May 1, 2009

(65) Prior Publication Data

US 2009/0275372 A1 Nov. 5, 2009

Related U.S. Application Data

(60) Provisional application No. 61/049,527, filed on May 1, 2008.

(51) Int. Cl.
*A63F 9/24* (2006.01)

(52) U.S. Cl. ..... 463/9

(58) Field of Classification Search ..... 463/9
See application file for complete search history.

(56) References Cited

U.S. PATENT DOCUMENTS

| | | | | |
|---|---|---|---|---|
| 5,026,068 | A * | 6/1991 | Weisser | 273/241 |
| 5,080,368 | A * | 1/1992 | Weisser | 273/241 |
| 7,114,721 | B2 * | 10/2006 | Micarelli | 273/242 |
| 2009/0275372 | A1 * | 11/2009 | Prucey | 463/9 |

* cited by examiner

*Primary Examiner* — David E Graybill
(74) *Attorney, Agent, or Firm* — Howard & Howard Attorneys PLLC

(57) ABSTRACT

A puzzle game includes a plurality of game pieces arranged in an arrangement of game pieces. Each of the game pieces includes a matrix of polytopes. Each of the polytopes of each of the game pieces includes one of a pre-determined number of individual indicia disposed thereon, which is different than the individual indicia disposed on all of the other polytopes of the respective game pieces. The arrangement of game pieces includes a pre-determined number of rows and columns of polytopes. The game pieces are re-positioned within the arrangement of game pieces so that each of the individual indicia is displayed only once in each row of polytopes in the arrangement of game pieces and is displayed only once in each column of polytopes in the arrangement of game pieces.

37 Claims, 4 Drawing Sheets

26 FIG. 1

PUZZLE GAME

CROSS REFERENCE TO RELATED APPLICATION

This application claims the benefit of U.S. Provisional Patent Application Ser. No. 61/049,527 filed on May 1, 2008, the disclosure of which is hereby incorporated by reference.

BACKGROUND OF THE INVENTION

1. Field of the Invention

The subject invention generally relates to a puzzle game, and more specifically to a puzzle game related to Latin Squares.

2. Description of the Related Art

A Latin Square is any n×n table filled with different symbols in such a way that each symbol occurs exactly once in each row and exactly once in each column. Many puzzle games utilize the concept of the Latin Square.

One such puzzle game that utilizes the Latin Square is commonly referred to as "Sudoku". The Sudoku game is a puzzle game that once completed forms a special case of a Latin Square. The Sudoku game includes a plurality of sub-squares arranged in an n×n matrix. Each of the sub-squares comprises a plurality of blocks, with the blocks arranged in an n×n matrix. During setup of the Sudoku game, at least one of the blocks of each of the sub-squares is assigned a numerical value. The remainder of the blocks is left blank for a player to fill in.

To play the Sudoku game, a player assigns each of the remaining blank blocks a numerical value common to each sub-square, such that each of the numerical values occurs exactly once in each of the rows, exactly once in each of the columns and exactly once in each of the sub-squares of the table. Once properly completed, all of the blocks in all of the sub-squares are filled in with a numerical value, and each of the blocks in each of the sub-squares includes a different numerical value. There is exactly one solution to the Sudoku game.

U.S. Pat. No. 3,592,474 to O'Neil (the '474 patent) discloses another type of puzzle game. The puzzle game of the '474 patent includes four game pieces, with each game piece including sixteen (16) smaller squares arranged in a four by four (4×4) matrix. Two of the smaller squares within each of the game piece matrices include markings thereon. The remainder of the smaller squares within each of the game piece matrices are identical, and includes no markings thereon. The playing squares may be re-positioned relative to the other game pieces by swapping positions with other game pieces and/or by rotating individual game pieces. The object of the puzzle game is to place the four game pieces into a large square wherein there is not more than one marker in any row, not more than one marker in any column and not more than one marker in any diagonal.

Interest in various puzzle games, such as those described above, wanes after repetitive play. Accordingly, there continuously remains a need for new and interesting puzzle games that strengthen the brain, increase comprehension and increase cognitive skills.

SUMMARY OF THE INVENTION AND ADVANTAGES

The subject invention provides a puzzle game having a game board presenting a surface. A plurality of game pieces are disposed on the surface of the game board. The plurality of game pieces are moveable on the surface relative to each other. Each of the plurality of game pieces includes a plurality of polytopes, with the plurality of polytopes defining a matrix of polytopes. The plurality of game pieces are positioned on the game board relative to each other to define an arrangement. The arrangement of game pieces includes a pre-determined number of rows of polytopes and a pre-determined number of columns of polytopes. Each polytope of the matrix of polytopes includes one of a pre-determined number of individual indicia displayed thereon. The individual indicia displayed on each polytope of the matrix of polytopes on each of the game pieces is different from the individual indicia on all other of the polytopes within each of the matrix of polytopes.

The subject invention also provides a method of playing the puzzle game. The method comprises the step of positioning the plurality of game pieces relative to each other to define the arrangement, with the arrangement including the pre-determined number of rows of polytopes and the pre-determined number of columns of polytopes. The method further comprises the step of re-positioning at least one of the plurality of game pieces so that each of the individual indicia is displayed only once in each row of polytopes and is displayed only once in each column of polytopes.

Accordingly, the subject invention provides a new and unique puzzle game that may interest players who have become tired of previous puzzle games. The puzzle game of the subject invention requires thought and analysis of the position of the game pieces and the ways in which the game pieces may be re-positioned to win the game, which help to strengthen the brain, increase comprehension and increase cognitive skills.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Referring to the Figures, wherein like numerals indicate corresponding parts throughout the several views, a puzzle game is shown generally at 20.

Figure 1:
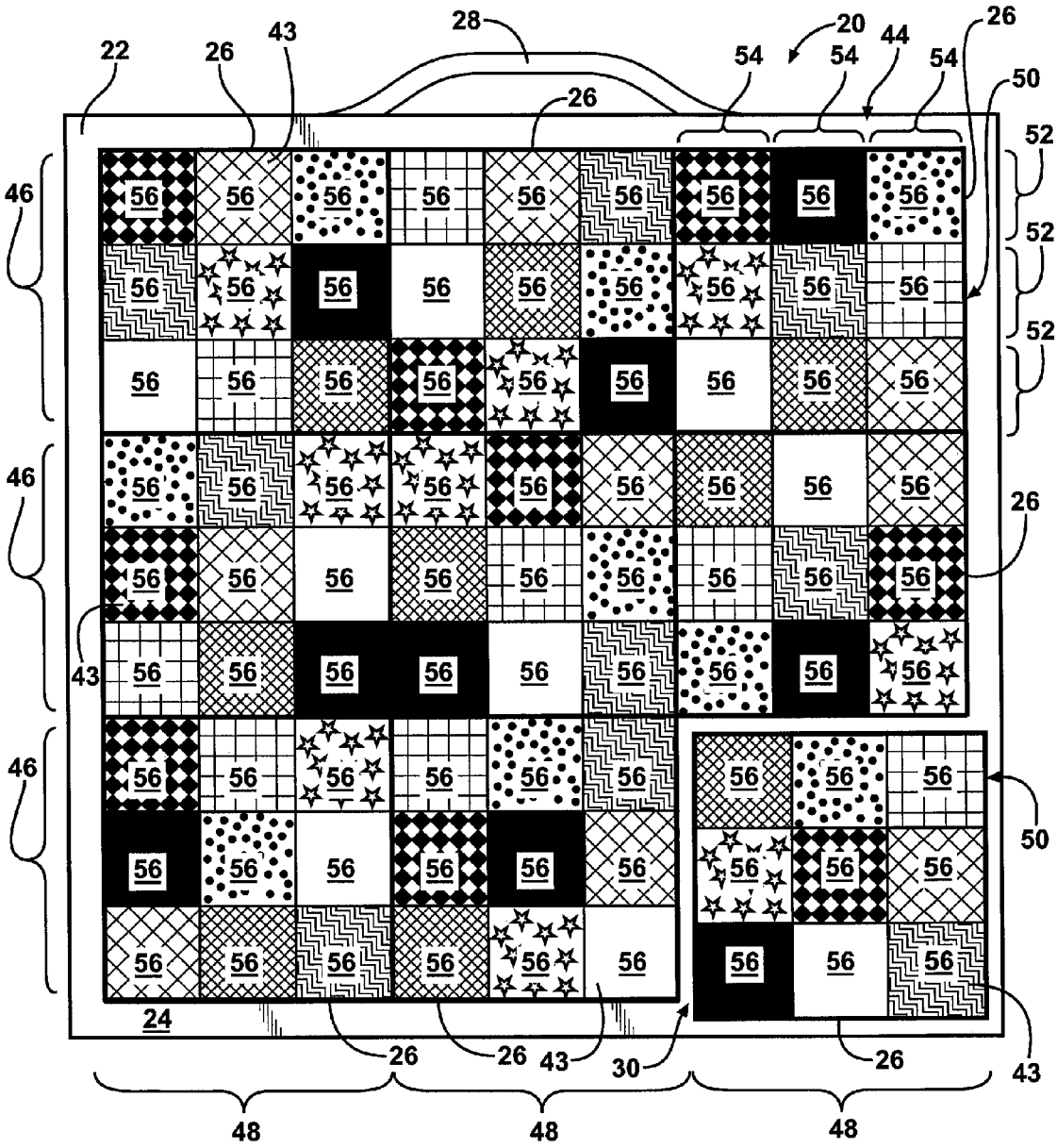
FIG. 1 is a plan view of a first embodiment of a puzzle game embodied as a board game in an uncompleted state.
Figure 2:
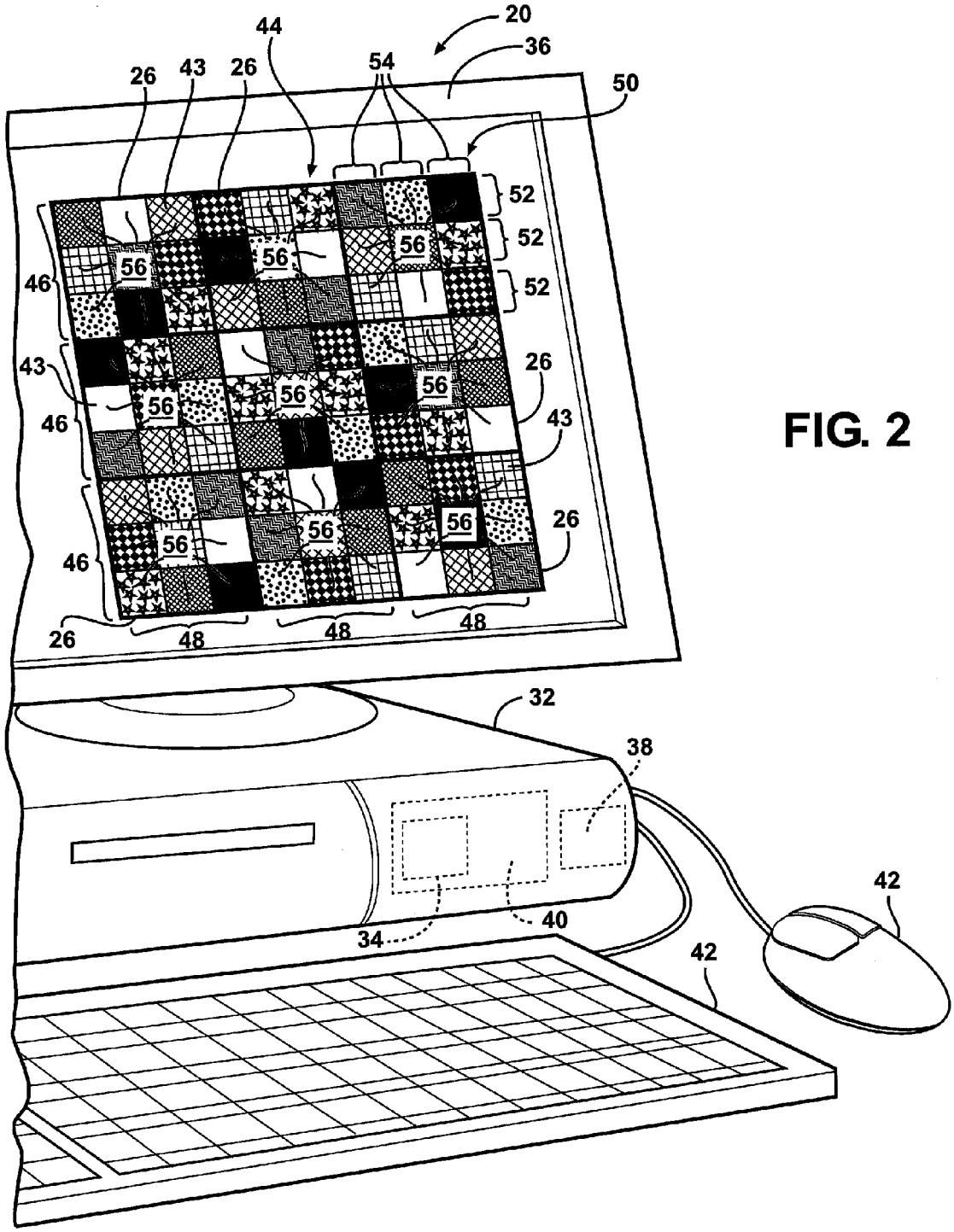
FIG. 2 is a perspective view of the first embodiment of the puzzle game embodied as a computer game in a completed state.

As shown in FIG. 1, the puzzle game 20 is embodied as a board game. As shown in FIG. 2, the puzzle game 20 is embodied as a computer game. It should be appreciated that the puzzle game 20 may be embodied in some other manner not mentioned or described herein.

Referring to FIG. 1, wherein a first embodiment of the puzzle game 20 is shown as a board game, the puzzle game 20 comprises a game board 22. The game board 22 presents a playing surface 24. The playing surface 24 is flat, and may be disposed horizontally or vertically as described below.

The puzzle game 20 includes a plurality of game pieces 26. The game pieces 26 are disposed on the playing surface 24 of the game board 22, and are described in detail below.

As shown in FIG. 1, the game board 22 includes a hanger 28. The hanger 28 is attached to an edge of the game board 22, and may be utilized to support the game board 22 on a vertical surface, i.e., the hanger 28 may be utilized to hang the game board 22 on a vertical wall. As such, the puzzle game 20 may also be utilized as a piece of art on the wall. Of course, it should be appreciated that the game board 22 may also be supported horizontally on a surface, such as table. The hanger 28 may include any desirable shape and/or configuration capable of securely and stably supporting the weight of the game board 22 and the game pieces 26.

In order to facilitate use of the game board 22 on a vertical surface, the puzzle game 20 may include an attachment mechanism 30. The attachment mechanism 30 releasably attaches the plurality of game pieces 26 to the game board 22 when the game board 22 is supported either horizontally or vertically. The attachment mechanism 30 attaches the game pieces 26 such that each of the plurality of game pieces 26 is re-positionable on the game board 22. In other words, the attachment mechanism 30 permits each of the game pieces 26 to be repeatably removed from and replaced onto the game board 22, and secures the game pieces 26 to the game board 22 whether oriented vertically or horizontally.

The attachment mechanism 30 may include any suitable system incorporated into the game board 22 and/or the game pieces 26 respectively. More specifically, the attachment mechanism 30 may include, but is not limited to, one of a magnetic attachment mechanism, an adhesive attachment mechanism, a static attachment mechanism, and a hook and loop attachment mechanism. For example, if the attachment mechanism 30 includes the magnetic attachment mechanism, then the game board 22 may include a magnetic material and the game pieces 26 may include a magnet. It should be appreciated that the attachment mechanism 30 may include other devices capable of releasably attaching the game pieces 26 to the game board 22 that are not specifically shown or discussed herein.

Referring to FIG. 2, wherein the puzzle game 20 is shown as a computer game, the puzzle game 20 includes a computer 32. The computer 32 has access to software 34 that enables a player to play the puzzle game 20 on the computer 32. The software 34 enables the computer 32 to display the game board 22 and/or display only the game pieces 26 on a display 36, e.g., a screen, monitor or the like. As is well known in the art, the software 34 includes computer code that directs the computer 32 to perform a set of pre-defined functions necessary to operate the computer 32 to run the puzzle game 20. The software 34 further enables the player to enter commands into the computer 32 to control the position of the game pieces 26 relative to each other. It is known to one skilled in the art how to encode the software 34 with the required instructions to carry out the necessary operations on the computer 32. Therefore, the specifics of the software 34 are not described in detail herein.

The computer 32 includes a processor 38, a memory 40 and other sub-components as is well known in the art. The computer 32 may include a standard desktop computer having an attached monitor and an attached data entry device 42, such as a keyboard or a mouse; a laptop computer; a mobile telephone; a stand alone game counsel; or some other similar device. It should be appreciated that the computer 32 may include some other device capable of displaying the game pieces 26 and controlling the position of the game pieces 26 that is not specifically described or shown herein.

The computer 32 may store the software 34 in the memory 40 of the computer 32. Alternatively, the computer 32 may access the software 34, i.e., the computer 32 may be in communication with the software 34, to operate the puzzle game 20 thereon from the internet, network or the like. The software 34 may be accessed via a network, a wireless network, a portable mobile telephone or some other suitable communication system.

Referring to FIGS. 1 and 2, each of the game pieces 26 is moveable on the surface 24 relative to each other. Each of the plurality of game pieces 26 includes a plurality of polytopes 43, which cooperate to define a matrix of polytopes 50. A polytope 43, as used herein, is a broad term that covers a wide variety of objects. For example, a polytope can refer to a two-dimensional polygon, a three-dimensional polyhedron, or any of the various generalizations thereof. Throughout the Figures, the polytope 43 is illustrated as a two-dimensional square. However, it should be appreciated that the polytope 43 may be of a variety of shapes, such as a rectangle, triangle, circle, parallelogram, octogon, etc. Accordingly, the scope of the subject invention is not limited to square polytopes or even two-dimensional objects as shown through the Figures.

Each of the matrix of polytopes 50 of the plurality of game pieces 26 include a predetermined number of rows of polytopes 52 and a pre-determined number of columns of polytopes 54. As shown in FIGS. 1 and 2, the pre-determined number of rows of polytopes 52 in the matrix of polytopes 50 is equal to the pre-determined number of columns of polytopes 54 in the matrix of polytopes 50. With reference to a third embodiment of the puzzle game 120 shown in FIG. 4 and described in detail below, it should be appreciated that the pre-determined number of rows of polytopes 52 in the matrix of polytopes 50 may differ from the pre-determined number of columns of polytopes 54 in the matrix of polytopes 50.

Figure 3:
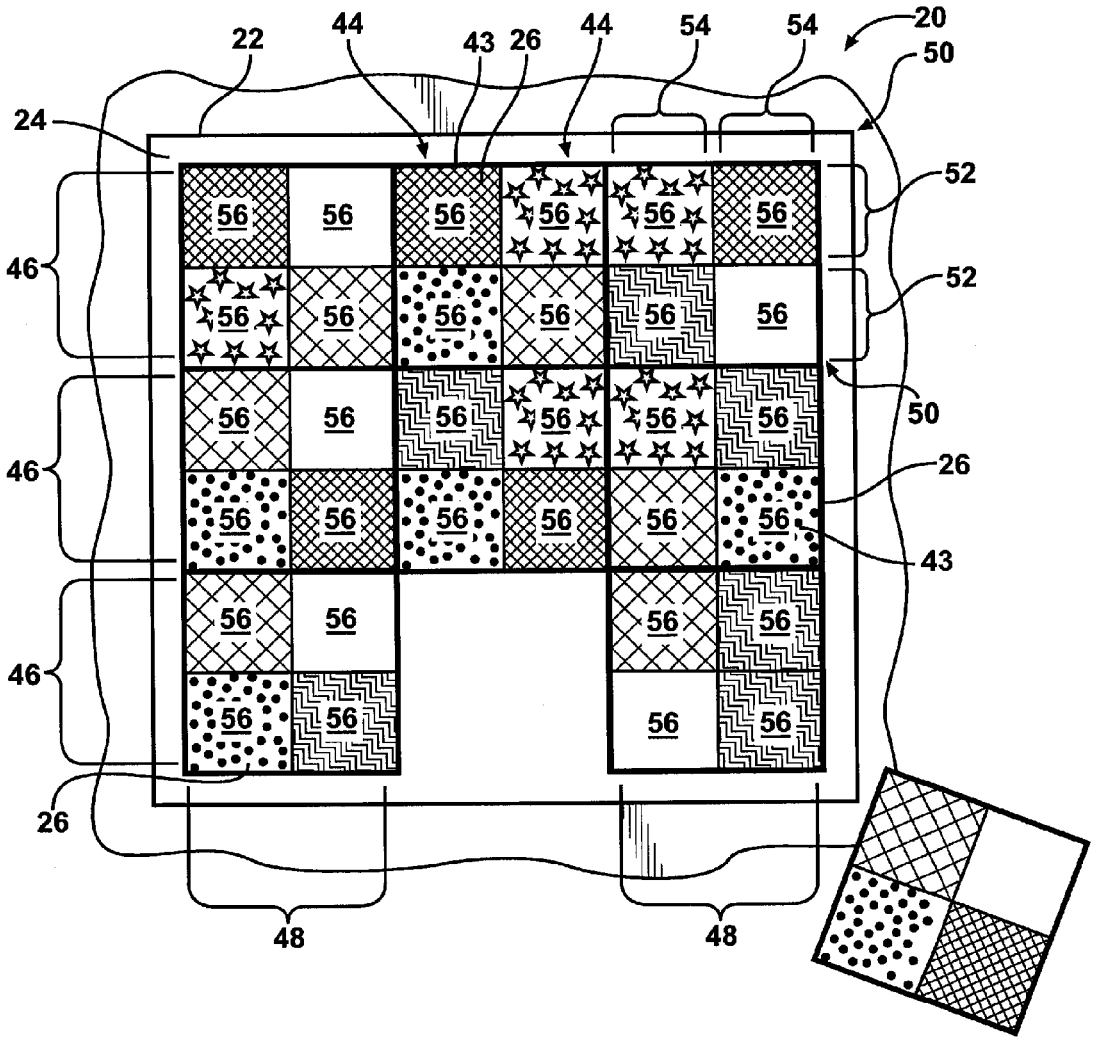
FIG. 3 is a plan view of a second embodiment of the puzzle game embodied as a board game.

As shown in FIGS. 1 and 2, the number of rows of polytopes 52 in the matrix of polytopes 50 is equal to three (3), and the number of columns of polytopes 54 in the matrix of polytopes 50 is equal to three (3). However, it should be appreciated that the number of rows of polytopes 52 and the number of columns of polytopes 54 in the matrix of polytopes 50 may equal any natural number, such as 1, 2, 3, 4, etc. For example, referring to FIG. 3 wherein a second embodiment of the puzzle game 20 is shown, each of the game pieces 26 includes two (2) rows of polytopes 52 in the matrix of polytopes 50 and two (2) columns of polytopes 54 in the matrix of polytopes 50. The larger the number of rows of polytopes 52 and the larger the number of columns of polytopes 54 within the matrix of polytopes 50, the larger the puzzle game 20 becomes and the more difficult the puzzle game 20 becomes to solve and thereby win.

The plurality of game pieces 26 is positioned on the game board 22 relative to each other to define an arrangement of game pieces 26. The arrangement of game pieces 26 includes a pre-determined number of rows of polytopes 43 and a pre-determined number of columns of polytopes 43. The number of rows of polytopes 43 in the arrangement of game pieces 26 is equal to the number of columns of polytopes 43 in the arrangement of game pieces 26. It should be appreciated that all of the game pieces 26 contribute to the pre-determined number of rows of polytopes 43 and the pre-determined number of columns of polytopes 43 within the arrangement of game pieces 26. It should also be appreciated that the number of rows of polytopes 43 within the arrangement of game pieces 26 is different than the number of rows of polytopes 52 within the matrix of polytopes 50. Likewise, the number of columns of polytopes 43 within the arrangement of game pieces 26 is different than the number of columns of polytopes 54 within the matrix of polytopes 50.

As shown in FIGS. 1 and 2, the plurality of game pieces 26 is positioned relative to each other in a matrix of game pieces 44. The matrix of game pieces 44 includes a pre-determined number of rows of game pieces 46 and a pre-determined number of columns of game pieces 48. With reference to the third embodiment of the puzzle game 120 shown in FIG. 4 and described in detail below, it should also be appreciated that the plurality of game pieces 26 may be arranged in such a manner to not define a matrix of game pieces 44.

Preferably, the pre-determined number of rows of game pieces 46 in the matrix of game pieces 44 is equal to three (3) and the pre-determined number of columns of game pieces 48 in the matrix of game pieces 44 is equal to three (3). However, it should be appreciated that the pre-determined number of rows of game pieces 46 within the matrix of game pieces 44 and the pre-determined number of columns of game pieces 48 within the matrix of game pieces 44 may equal some other natural number greater than one (1), such as 2, 3, 4, etc. Accordingly, it should be appreciated that the number of rows of game pieces 46 and the number of columns of game pieces 48 within the matrix of game pieces 44 may differ from the three (3) shown and described herein in the embodiment shown in FIGS. 1 and 2. The larger the number of rows of game pieces 46 and the larger the number of columns of game pieces 48 within the matrix of game pieces 44, the larger the puzzle game 20 becomes and the more difficult the puzzle game 20 becomes to solve and thereby win.

Each polytope 43 of the matrix of polytopes 50 includes one of a pre-determined number of individual indicia 56 displayed thereon. The individual indicia 56 displayed on each polytope 43 of the matrix of polytopes 50 on each of the game pieces 26 are different from the individual indicia 56 on all other of the polytopes 43 within each of the matrix of polytopes 50. In other words, no two polytopes 43 within any single game piece 26 include the same individual indicia 56 thereon. The pattern of the individual indicia 56 on each of the game pieces 26 may be identical to the pattern of the individual indicia 56 on the other game pieces 26. Alternatively, the pattern of the individual indicia 56 on each of the game pieces 26 may be dissimilar, i.e., not identical, to the pattern of the individual indicia 56 on the other game pieces 26, such as is shown in the second embodiment of the puzzle game 20 shown in FIG. 3.

The pre-determined number of individual indicia 56 is equal to the pre-determined number of rows of polytopes 52 in the arrangement of game pieces 26 and the pre-determined number of columns of polytopes 54 in the arrangement of game pieces 26. Accordingly, in the embodiment of the puzzle game 20 shown in FIGS. 1 and 2, the number of rows of polytopes 52 in the arrangement of game pieces 26 is equal to nine (9), and the number of columns of polytopes 54 in the arrangement of game pieces 26 is equal to nine (9). Therefore, the number if individual indicia 56 is also equal to nine (9).

As shown in the first embodiment of the puzzle game 20 shown in FIGS. 1 and 2, each of the game pieces 26 includes all of the individual indicia 56 displayed thereon. However, it should be appreciated that the game pieces 26 need not include all of the individual indicia 56 thereon. For example, referring to the second embodiment of the puzzle game 20 shown in FIG. 3, the arrangement of game pieces 26 includes a matrix of game pieces 44 having three (3) rows of game pieces 46 and three (3) columns of game pieces 48, with each matrix of polytopes 50 on each game piece 26 having two (2) rows of polytopes 52 and two (2) columns of polytopes 54, the total number of rows of polytopes 43 in the arrangement of game pieces 26 is equal to six (6) and the total number of columns of polytopes 43 in the arrangement of game pieces 26 is equal to six (6). Therefore, the total number of individual indicia 56 is also equal to six (6). Accordingly, each game piece will only include four (4) of the six (6) individual indicia 56 disposed thereon.

The individual indicia 56 of each of the polytopes 43 in the matrix of polytopes 50 of each of the game pieces 26 may include individual indicia 56 chosen from a group of indicia including, but not limited too: colors, letters, numbers, symbols and shapes. For illustrative purposes, many of the individual indicia 56 are shown having various line patterns. However, it should be appreciated that the individual indicia 56 may include other indicia not shown or described herein. As shown in FIGS. 1 and 2, the individual indicia 56 of seven (7) of the polytopes 43 of each game piece 26 include separate and distinguishable line patterns. There is also one polytope 43 that is blank and one polytope 43 that is black. As such, for the game pieces 26 of FIGS. 1 and 2, the individual indicia 56 include nine (9) different numbers, letters, colors, etc. A preferred embodiment includes the individual indicia 56 of each game piece 26 having a different color, which are easily distinguished from each other.

The subject invention also provides a method of playing the puzzle game 20. If the puzzle game 20 is being played on a game board 22, the method includes the step of providing the game board 22 having the game pieces 26 attached thereto. If the puzzle game 20 is being played on the computer 32, then the method includes the step of providing the computer 32 in communication with the software 34 for playing the puzzle game 20 on the computer 32.

The method further includes the step of mixing the plurality of game pieces 26 from the provided game board 22. In order to begin the puzzle game 20, the game pieces 26 are removed from the game board 22 and shuffled to mix the game pieces 26 relative to each other. If the puzzle game 20 is being played on the game board 22, such as shown in FIG. 1, then the game pieces 26 are physically moved around, which may include sliding the game pieces 26 around on the game board 22 relative to each other to mix the game pieces 26, or removing the game pieces 26 from the game board 22 to mix the game pieces 26 relative to each other. If the puzzle game 20 is being played on the computer 32, such as shown in FIG. 2, then the player inputs a command to mix the game pieces 26, whereby the software 34 operates to mix the game pieces 26 into a configuration suitable for beginning play. The shuffling of the game pieces 26, either manually or electronically, can be performed randomly or organized in a predetermined start pattern. It should be recognized that the puzzle game 20 will be more or less difficult depending on how the game pieces are initially positioned.

Once the game pieces 26 are mixed, the method further comprises the step of positioning the plurality of game pieces 26 relative to each other to define the arrangement of game pieces 26. As described above, the arrangement of game pieces 26 includes the pre-determined number of rows of polytopes 43 and the pre-determined number of columns of polytopes 43. Accordingly, it should be appreciated that the step of positioning the game pieces 26 in the arrangement of game pieces 26 prepares the puzzle game 20 for play. As such, it should be appreciated that the step of mixing the game pieces 26 occurs prior to the step of positioning the plurality of game pieces 26 in the arrangement of game pieces 26. FIG. 1 shows the game pieces 26 in a mixed state, ready to begin game play.

The step of positioning the plurality of game pieces 26 relative to each other to define the arrangement of game pieces 26 may be further defined as positioning the plurality of game pieces 26 relative to each other to define the matrix of game pieces 44. As described above, the matrix of game pieces 44 includes the pre-determined number of rows of game pieces 46 and a pre-determined number of columns of game pieces 48. It should be appreciated that the arrangement of game pieces 26 may not be in a true matrix, such as in the third embodiment of the puzzle game 120 shown in FIG. 4 and described in detail below.

Once the plurality of game pieces 26 is positioned in the arrangement of game pieces 26, the puzzle game 20 is ready to begin play. It should be appreciated that at the beginning of play, all of the polytopes 43 in all of the game pieces 26 include individual indicia 56 displayed thereon, with the individual indicia 56 on each polytope 43 on each game piece 26 being different from the individual indicia 56 on all other polytopes 43 of their respective game pieces 26.

The method further includes the step of re-positioning at least one of the plurality of game pieces 26. The game is won when the game pieces 26 are re-positioned so that each of the individual indicia 56 is displayed only once in each row of polytopes 43 in the arrangement of game pieces 26 and is displayed only once in each column of polytopes 43 in the arrangement of game pieces 26. In other words, each individual indicia 56 may be displayed only once in each vertical column of the arrangement of game pieces 26 and only once in each horizontal row of the arrangement of game pieces 26. FIG. 2 shows the game pieces 26 in a completed state, after the puzzle game 20 is solved.

There are multiple possible winning solutions to the puzzle game 20. The total possible number of winning solutions is equal to the number of rows of polytopes 43 in the arrangement of game pieces 26 and the number of columns of polytopes 43 in the arrangement of game pieces 26, e.g., there are nine (9) winning solutions for the embodiment of the puzzle game 20 shown in FIGS. 1 and 2, wherein there are nine (9) rows of polytopes 43 in the arrangement of game pieces 26 and nine (9) columns of polytopes 43 in the arrangement of game pieces 26.

It should be appreciated that it is the individual game pieces 26 that are re-positioned, and not the polytopes 43 within each of the game pieces 26. In other words, the pattern of polytopes 43 relative to each other on each of the game pieces 26 is fixed, and it is the game pieces 26 that are re-positioned.

The step of re-positioning at least one of the plurality of game pieces 26 may further be defined as swapping a position of at least one of the plurality of game pieces 26 with another of the plurality of game pieces 26. In other words, the game may be played by swapping the relative positions of two of the game pieces 26 within the arrangement of game pieces 26. The step of swapping the position of the game pieces 26 may be performed multiple times if required by the specific game play.

The step of re-positioning at least one of the plurality of game pieces 26 may further be defined as rotating at least one of the plurality of game pieces 26 about a center of the at least one of the plurality of game pieces 26. The step of rotating the at least one of the plurality of game pieces 26 is further defined as rotating the at least one of the plurality of game pieces 26 a multiple of ninety degrees (90°), e.g., 90°, 180°, 270°. The game pieces 26 may be rotated either clockwise or counterclockwise. Accordingly, the step of rotating the at least one of the plurality of game pieces 26 is further defined as rotating the at least one of the plurality of game pieces 26 in one of a clockwise direction and a counterclockwise direction. The step of rotating the position of the game pieces 26 may be performed multiple times if required by the specific game play.

If the puzzle game 20 is embodied to include a matrix of game pieces 44 as described above, then the step of re-positioning at least one of the plurality of game pieces 26 may further defined as repositioning at least one of the plurality of game pieces 26 within the matrix of game pieces 44.

If the puzzle game 20 is being played on the computer 32, then the method may further include the step of entering a command into the computer 32 to direct the computer 32 to perform at least one of the positioning step and the re-positioning step. The command may be entered into the computer 32 in any manner suitable for the specific type of computer 32, such as through a keyboard, a mouse, a touch screen, a telephone keypad, or some other device suitable for entering commands into the computer 32 that is not shown or described herein.

Figure 4:
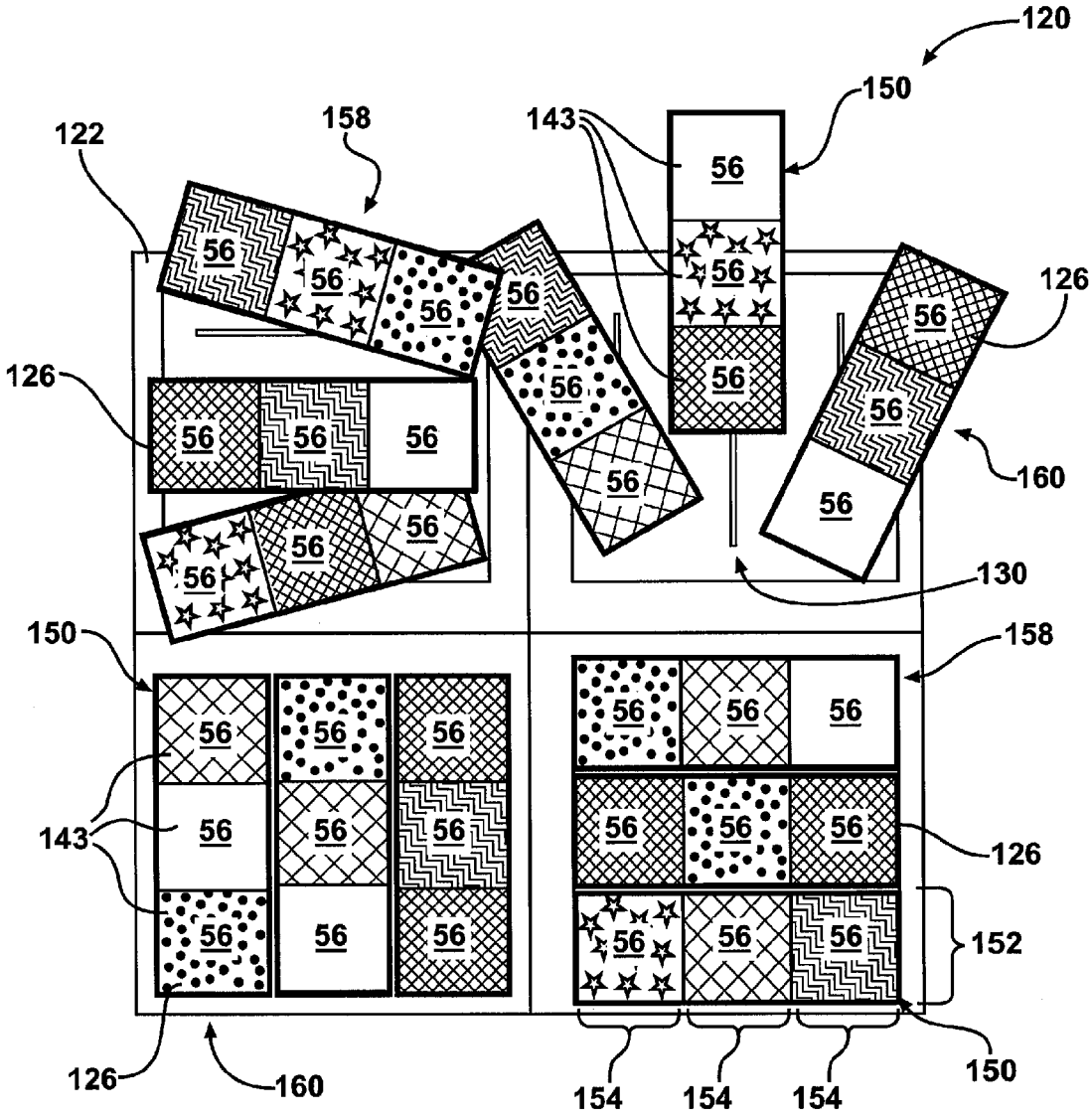
FIG. 4 is a plan view of a third embodiment of the puzzle game embodied as a board game.

Referring to FIG. 4, the third embodiment of the puzzle game is shown generally at 120. Features of the third embodiment of the puzzle game 120 similar to the first embodiment of the puzzle game 20, shown in FIGS. 1 and 2, include the same reference number increased by one hundred (100). For example, the reference numeral 26 is utilized to identify the game piece in the first embodiment of the puzzle game 20, whereas the reference is 126 is utilized to identify the game piece in the third embodiment of the puzzle game 120.

Within the third embodiment of the puzzle game 120, the pre-determined number of rows of polytopes 152 in the matrix of polytopes 150 does not equal the pre-determined number of columns of polytopes 154 in the matrix of polytopes 150.

The pre-determined number of rows of polytopes 152 in the matrix of polytopes 150 is equal to one (1) and the pre-determined number of columns of polytopes 154 in the matrix of polytopes 150 is equal to three (3). Accordingly, the matrix of polytopes 150 of each game piece 126 in the third embodiment of the puzzle game 120 includes a one by three (1×3) matrix. Accordingly, the third embodiment of the puzzle game 120 combines three game pieces 126 together to define the Latin polytope.

Additionally, the third embodiment of the subject invention includes the plurality of game pieces 126 having a first portion 158 of game pieces 126 and a second portion 160 of game pieces 126. The first portion 158 of game pieces 126 and the second portion 160 of game pieces 126 are arranged on the surface 124 perpendicularly relative to each other. As shown in FIG. 4, the first portion 158 of game pieces 126 includes two groups of game pieces 126, each group including three game pieces, with each group of the first portion 158 of game pieces 126 arranged in a horizontal manner on the surface 124, and the second portion 160 of game pieces 126 includes two groups of game pieces 126, each group including three game pieces 126, with each group of the second portion 160 of game pieces 126 arranged in a vertical manner on the surface 124 relative to the first group of game pieces 126.

The third embodiment of the puzzle game 120 is shown in FIG. 4 including twelve (12) game pieces 126 in total, with six (6) game pieces 126 in the first portion 158 and six (6) game pieces 126 arranged in the second portion 160. However, it should be appreciated that the number of game pieces 126 and the size of the matrix of polytopes 150 on each game piece 126 may vary from that shown, so long as the number of rows of polytopes 143 in the arrangement of game pieces 126 is equal to the number of columns of polytopes 143 in the arrangement of game pieces 126.

The third embodiment of the puzzle game 120 is played in the same manner as the first embodiment of the puzzle game 20, and requires the player to swap the position of game pieces 126 with other game pieces 126, and rotate the game pieces 126 within their respective groups of game pieces 126. The game is won when the game pieces 126 are re-positioned so that each of the individual indicia 156 is displayed only once in each row of polytopes 143 in the arrangement of game pieces 126 and is displayed only once in each column of polytopes 143 in the arrangement of game pieces 126.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. The use of the word "said" in the apparatus claims refers to an antecedent that is a positive recitation meant to be included in the coverage of the claims whereas the word "the" precedes a word not meant to be included in the coverage of the claims. In addition, any reference numerals in the claims are merely for convenience and are not to be read in any way as limiting. It is, therefore, to be understood that within the scope of the appended claims, the invention may be practiced otherwise than as specifically described.

What is claimed is:

1. A method of playing a puzzle game having a plurality of game pieces with each of the plurality of game pieces having a matrix of polytopes, wherein each polytope of each matrix of polytopes includes one of a pre-determined number of individual indicia displayed thereon with the individual indicia on each polytope within each matrix of polytopes being different than the individual indicia on all other of the polytopes within each matrix of polytopes, said method comprising the steps of:

positioning the plurality of game pieces relative to each other to define an arrangement having a pre-determined number of rows of polytopes and a pre-determined number of columns of polytopes; and re-positioning at least one of the plurality of game pieces so that each of the individual indicia is displayed only once in each row of polytopes and is displayed only once in each column of polytopes.

2. A method as set forth in claim 1 wherein the step of re-positioning at least one of the plurality of game pieces is further defined as swapping a position of the at least one of the plurality of game pieces with another of the plurality of game pieces.

3. A method as set forth in claim 1 wherein the step of re-positioning at least one of the plurality of game pieces is further defined as rotating the at least one of the plurality of game pieces about a center of the at least one of the plurality of game pieces.

4. A method as set forth in claim 3 wherein the step of rotating the at least one of the plurality of game pieces is further defined as rotating the at least one of the plurality of game pieces a multiple of ninety degrees (90°) in one of a clockwise direction and a counterclockwise direction.

5. A method as set forth in claim 1 further comprising the step of providing a game board to support the plurality of game pieces therein.

6. A method as set forth in claim 5 further comprising the step of mixing the plurality of game pieces on the game board prior to the step of positioning the plurality of game pieces relative to each other.

7. A method as set forth in claim 1 wherein the pre-determined number of rows of polytopes in the arrangement is equal to the pre-determined number of columns of polytopes in the arrangement.

8. A method as set forth in claim 7 wherein the number of individual indicia is equal to the pre-determined number of rows of polytopes in the arrangement of game pieces and the pre-determined number of columns of polytopes in the arrangement of game pieces.

9. A method as set forth in claim 1 wherein the individual indicia of each of the polytopes in the matrix of polytopes of each of the game pieces includes indicia chosen from a group of indicia including, colors, letters, numbers, symbols and shapes.

10. A method as set forth in claim 1 further comprising the step of providing a computer in communication with software for playing the puzzle game on the computer.

11. A method as set forth in claim 10 further comprising the step of entering a command into the computer to direct the computer to perform at least one of the positioning step and the re-positioning step.

12. A method as set forth in claim 1 wherein the matrix of polytopes of each of the plurality of game pieces includes a matrix having a pre-determined number of rows of polytopes and a pre-determined number of columns of polytopes.

13. A method as set forth in claim 12 wherein the pre-determined number of rows of polytopes in each matrix of polytopes and the pre-determined number of columns of polytopes in each matrix of polytopes are each equal to a natural number.

14. A method as set forth in claim 13 wherein the pre-determined number of rows of polytopes in each matrix of polytopes is equal to the pre-determined number of columns of polytopes in each matrix of polytopes.

15. A method as set forth in claim 14 wherein the pre-determined number of rows of polytopes in the matrix of polytopes is equal to three (3) and the pre-determined number of columns of polytopes in the matrix of polytopes is equal to three (3).

16. A method as set forth in claim 14 wherein the step of positioning the plurality of game pieces relative to each other to define an arrangement of game pieces is further defined as positioning the plurality of game pieces relative to each other to define a matrix of game pieces including a pre-determined number of rows of game pieces and a pre-determined number of columns of game pieces.

17. A method as set forth in claim 16 wherein the step of re-positioning at least one of the plurality of game pieces is further defined as repositioning at least one of the plurality of game pieces within the matrix of game pieces.

18. A method as set forth in claim 16 wherein the pre-determined number of rows of game pieces in the matrix of game pieces is equal to the pre-determined number of columns of game pieces in the matrix of game pieces.

19. A method as set forth in claim 18 wherein the pre-determined number of rows of game pieces in the matrix of game pieces is equal to three (3) and the pre-determined number of columns of game pieces in the matrix of game pieces is equal to three (3).

20. A method as set forth in claim 13 wherein the pre-determined number of rows of polytopes in the matrix of polytopes is not equal to the pre-determined number of columns of polytopes in the matrix of polytopes.

21. A method as set forth in claim 20 wherein a first portion of the plurality of game pieces is arranged perpendicularly relative to a second portion of the plurality of game pieces in the arrangement of game pieces.

22. A method as set forth in claim 21 wherein the pre-determined number of rows of polytopes in the matrix of polytopes is equal to one (1) and the pre-determined number of columns of polytopes in the matrix of polytopes is equal to three (3).

23. A method as set forth in claim 22 wherein the number of game pieces is equal to twelve (12).

24. A puzzle game comprising:

a game board presenting a surface; and a plurality of game pieces disposed on said surface of said game board and moveable on said surface relative to each other with each of said plurality of game pieces including a plurality of polytopes defining a matrix of polytopes;

wherein said plurality of game pieces is positioned on said game board relative to each other to define an arrangement of game pieces having a pre-determined number of rows of polytopes and a pre-determined number of columns of polytopes; and wherein each polytope of said matrix of polytopes includes one of a pre-determined number of individual indicia displayed thereon with said individual indicia displayed on each polytope of said matrix of polytopes on each of said game pieces being different from said individual indicia on all other of said polytopes within each of said matrix of polytopes.

25. A puzzle game as set forth in claim 24 wherein said pre-determined number of individual indicia is equal to said pre-determined number of rows of polytopes and said pre-determined number of columns of polytopes in said arrangement of game pieces.

26. A puzzle game as set forth in claim 24 wherein each of said matrix of polytopes of said plurality of game pieces include a pre-determined number of rows of polytopes and a pre-determined number of columns of polytopes.

27. A puzzle game as set forth in claim 24 wherein said game board includes a hanger for supporting said game board on a vertical surface.

28. A puzzle game as set forth in claim 24 further including an attachment mechanism releasably attaching said plurality of game pieces to said game board when said game board is supported either horizontally or vertically such that each of said plurality of game pieces are re-positionable on said game board.

29. A puzzle game as set forth in claim 28 wherein said attachment mechanism includes one of a magnetic attachment mechanism, an adhesive attachment mechanism, a static attachment mechanism, and a hook and loop attachment mechanism.

30. A puzzle game as set forth in claim 24 wherein said individual indicia on each of the polytopes in the matrix of polytopes of each of the game pieces includes individual indicia chosen from a group of indicia including, colors, letters, numbers, symbols and shapes.

31. A puzzle game as set forth in claim 24 further including a computer having access to software operable to display the game pieces and to control the position of the game pieces within the matrix of game pieces.

32. A puzzle game as set forth in claim 26 wherein said plurality of game pieces are positioned relative to each other in a matrix of game pieces having a pre-determined number of rows of game pieces and a pre-determined number of columns of game pieces.

33. A puzzle game as set forth in claim 32 wherein said pre-determined number of rows of game pieces in said matrix of game pieces is equal to said pre-determined number of columns of game pieces in said matrix of game pieces.

34. A puzzle game as set forth in claim 33 wherein said pre-determined number of rows of game pieces in said matrix of game pieces is equal to three (3) and said pre-determined number of columns of game pieces in said matrix of game pieces is equal to three (3).

35. A puzzle game as set forth in claim 26 wherein said pre-determined number of rows of polytopes in said matrix of polytopes does not equal said pre-determined number of columns of polytopes in said matrix of polytopes.

36. A puzzle game as set forth in claim 35 wherein said plurality of game pieces includes a first portion of game pieces and a second portion of game pieces with said first portion of game pieces and said second portion of game pieces arranged on a surface perpendicularly relative to each other.

37. A puzzle game as set forth in claim 36 wherein said pre-determined number of rows of polytopes in said matrix of polytopes is equal to one (1) and said pre-determined number of columns of polytopes in said matrix of polytopes is equal to three (3).

* * * * *